US006575628B1

(12) United States Patent
Borchardt et al.

(10) Patent No.: US 6,575,628 B1
(45) Date of Patent: Jun. 10, 2003

(54) CLOSURE DEVICE

(75) Inventors: Michael G. Borchardt, Naperville, IL (US); Alan F. Savicki, Naperville, IL (US)

(73) Assignee: The Glad Products, Oakland, CA (US)

( * ) Notice: Subject to any disclaimer, the term of this patent is extended or adjusted under 35 U.S.C. 154(b) by 0 days.

(21) Appl. No.: 09/913,786

(22) PCT Filed: Jun. 10, 1999

(86) PCT No.: PCT/US99/13117

§ 371 (c)(1),
(2), (4) Date: Aug. 15, 2001

(87) PCT Pub. No.: WO00/76346

PCT Pub. Date: Dec. 21, 2000

(51) Int. Cl.[7] ..... B65D 33/16

(52) U.S. Cl. ..... 383/64; 24/399; 24/427; 24/585.12

(58) Field of Search ..... 383/64; 24/585.12, 24/427, 428, 399, 400

(56) References Cited

U.S. PATENT DOCUMENTS 4,829,641 A 5/1989 Williams
5,007,143 A * 4/1991 Herrington ..... 24/400
5,010,627 A * 4/1991 Herrington et al. ..... 24/400
5,067,208 A * 11/1991 Herrington et al. ..... 24/400
5,070,583 A * 12/1991 Herrington ..... 24/400
5,384,942 A * 1/1995 Siegel ..... 24/585.12
5,442,838 A 8/1995 Richardson et al.
5,836,056 A 11/1998 Porchia et al.
6,178,602 B1 * 1/2001 Burke et al. ..... 24/30.5 R
6,220,754 B1 * 4/2001 Stiglic et al. ..... 383/64
6,385,818 B1 * 5/2002 Savicki, Sr. ..... 24/30.5 R

* cited by examiner

*Primary Examiner*—Stephen P. Garbe
(74) *Attorney, Agent, or Firm*—Thomas C. Feix

(57) ABSTRACT

The closure device includes interlocking fastening strips (130, 131) and a slider (132) slidably disposed on the fastening strips for facilitating the occlusion and deocclusion of the fastening strips (130, 131) when moved towards first and second ends thereof. The slider (132) is provided with a separator (172) for driving fastening strips horizontally outward at different rates. The separator (172) initially drives the fastening strips (130, 131) outward at the same rate and then continues to drive one strip outward while holding the other substantially stationary to facilitate deocclusion of the fastening strips. The fastening strips (130, 131) include guide rails (139, 143). The guide rails (139, 143) are disposed between upper and lower sets of interlocking closure portions. The slider (132) includes guide tracks (221, 222) which engage the guide rails (139, 143) on the fastening strips. The separator (172) drives the upper closure portions outward and the lower closure portions inward by pivoting about the guide rails (139, 143) to facilitate shearing between the lower closure portions.

33 Claims, 12 Drawing Sheets

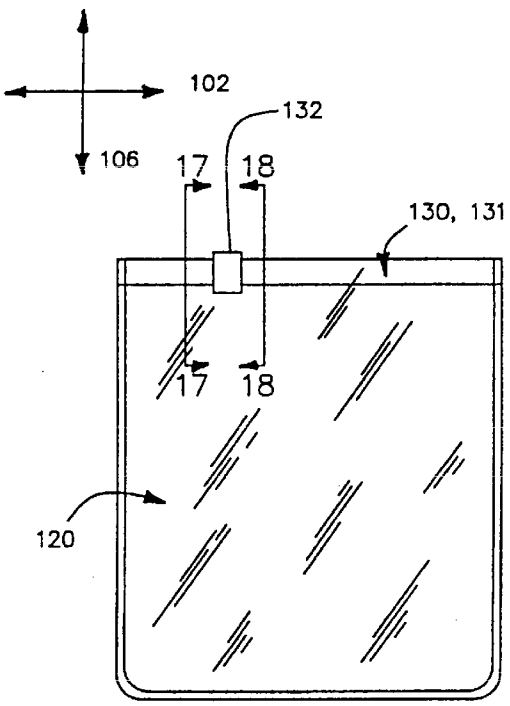
Fig. 11
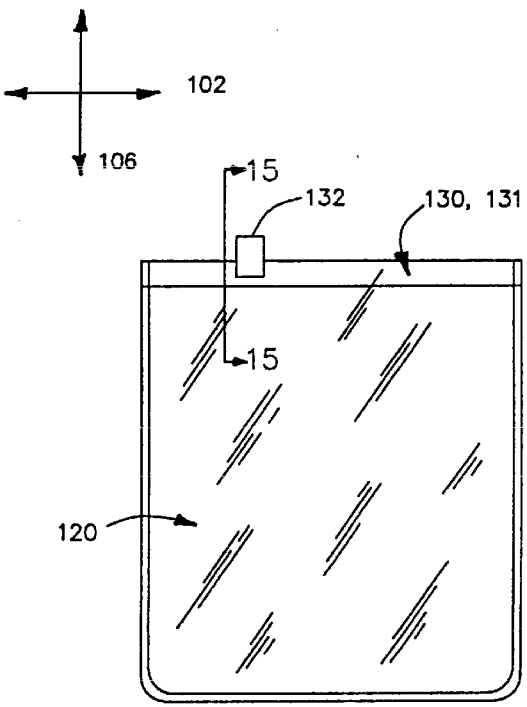
Fig. 12
Fig. 13

CLOSURE DEVICE

FIELD OF THE INVENTION

The present invention relates generally to closure devices and, more particularly, to a slider and interlocking fastening strips. The inventive closure devices may be employed in traditional fastener areas, and is particularly well suited for fastening flexible storage containers, including plastic bags.

BACKGROUND OF THE INVENTION

The use of closure devices for fastening storage containers, including plastic bags, is generally well known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the side walls of the container are integrally formed by extrusion as a single piece. Alternatively, the closure device and side walls of the container may be formed as separate pieces and then connected by heat sealing or any other suitable connecting process. In either event, such closure devices are particularly useful in providing a closure means for retaining matter within the bag.

Conventional closure devices typically utilize mating fastening strips which are used to selectively seal the bag. With such closure devices, however, it is often difficult to determine whether the fastening strips are fully occluded. This problem is particularly acute when the strips are relatively narrow. Accordingly, when such fastening strips are employed, there exists a reasonable likelihood that the closure device is at least partially open.

Such fastening strips devices are also particularly difficult to handle by individuals with limited manual dexterity. Thus, in order to assist these individuals and for ease of use by individuals with normal dexterity, the prior art has also provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator which extends at least partially between the fastening strips. When the slider is moved in the appropriate direction, the separator divides the fastening strips and opens the bag.

SUMMARY OF THE INVENTION

The closure device includes interlocking fastening strips disposed along respective edge portions of the opposing side walls, and a slider slidably disposed on the interlocking fastening strips for facilitating the occlusion and deocclusion of the fastening strips when moved towards first and second ends thereof. In accordance with the present invention, a slider is provided with a separator that drives upper ends of the fastened strips laterally apart at different controlled rates to lessen the amount of deflection and bending during deocclusion of the fastening strips.

A forward portion of the separator initially drives upper ends of the first and second fastening strips horizontally apart at about the same rate. A rearward portion of the separator then holds one of the fastening strips stationary in the horizontal axis while continuing to drive the other fastening strip horizontally outward.

The fastening strips may be one of many configurations. In one of the embodiments, the fastening strips have two sets of closure portions which form two seals between the fastening strips. The driving motion provided by the separator to the fastening strips provides for less deflection and bending in one of the sets of closure portions.

The fastening strips may include guide rails disposed between the upper and lower sets of interlocked closure portions. The guide rails slide along guide tracks provided by the housing of the slider. The guide rails also provide approximate pivot points about which the fastening strips may pivot to provide for the desired motion which facilitates easier shearing of the lower interlocked closure portions. An advantage of disposing the guide rail above the lower interlocked closure portions is that the slider may be more compact.

These and other features and advantages of the present invention will become more readily apparent upon reading the following detailed description of exemplified embodiments and upon reference to the accompanying drawings herein.

BRIEF DESCRIPTION OF THE DRAWINGS

FIG. 11 is a side view of the container in FIG. 1 and illustrates the slider positioned above the fastening strips;

FIG. 12 is a side view of the container in FIG. 1 and illustrates the slider as it is positioned onto the fastening strips;

FIG. 13 is a side view of the container in FIG. 1 and illustrates the slider fully attached to the fastening strips;

While the present invention will be described and disclosed in connection with certain embodiments and procedures, the intent is not to limit the present invention to these embodiments and procedures. On the contrary, the intent is to cover all such alternatives, modifications, and equivalents that fall within the spirit and scope of the present invention as defined by the appended claims.

DESCRIPTION OF THE EMBODIMENTS

Figure 1:
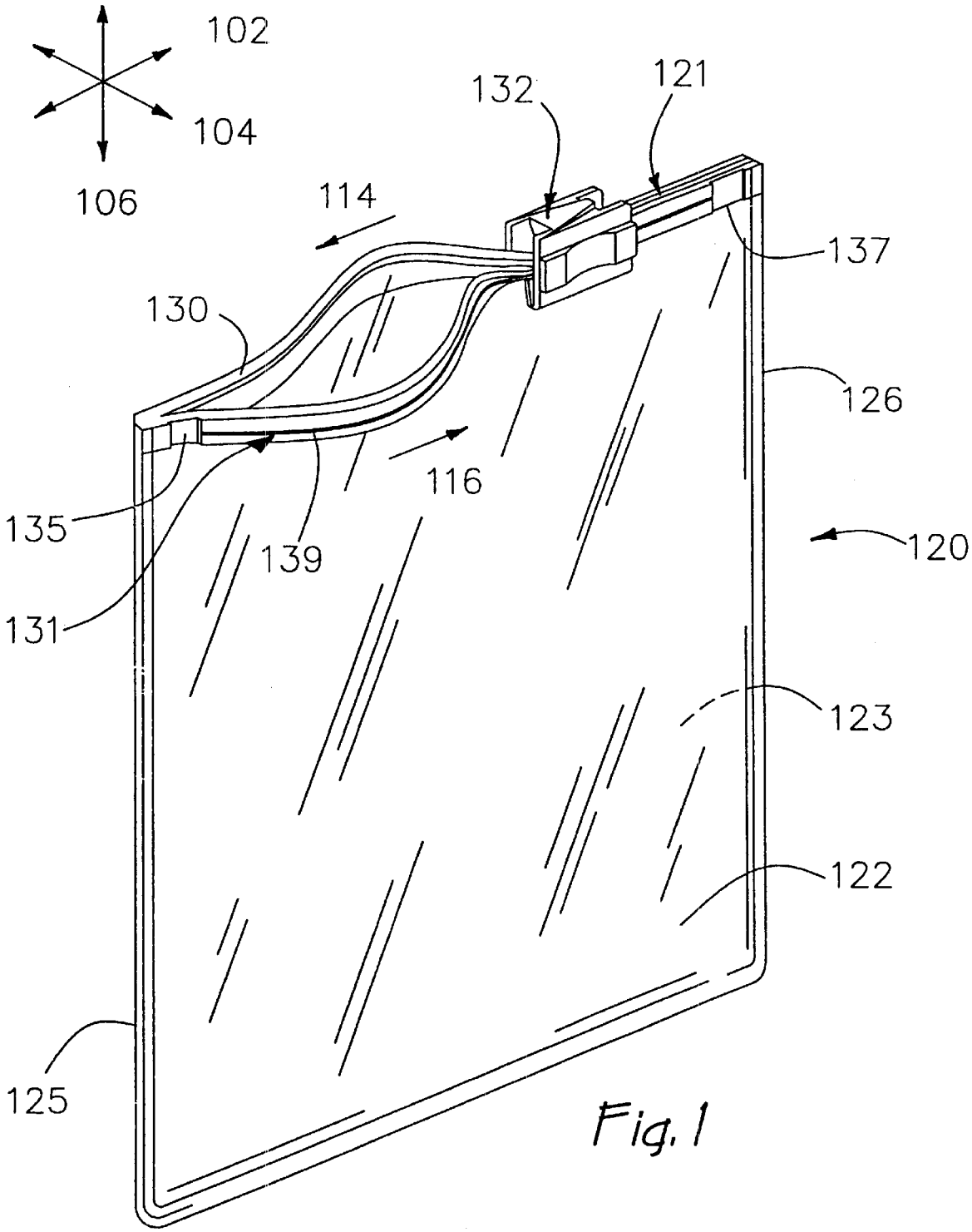
FIG. 1 is a perspective view of a container according to the present invention in the form of a plastic bag.
Figure 2:
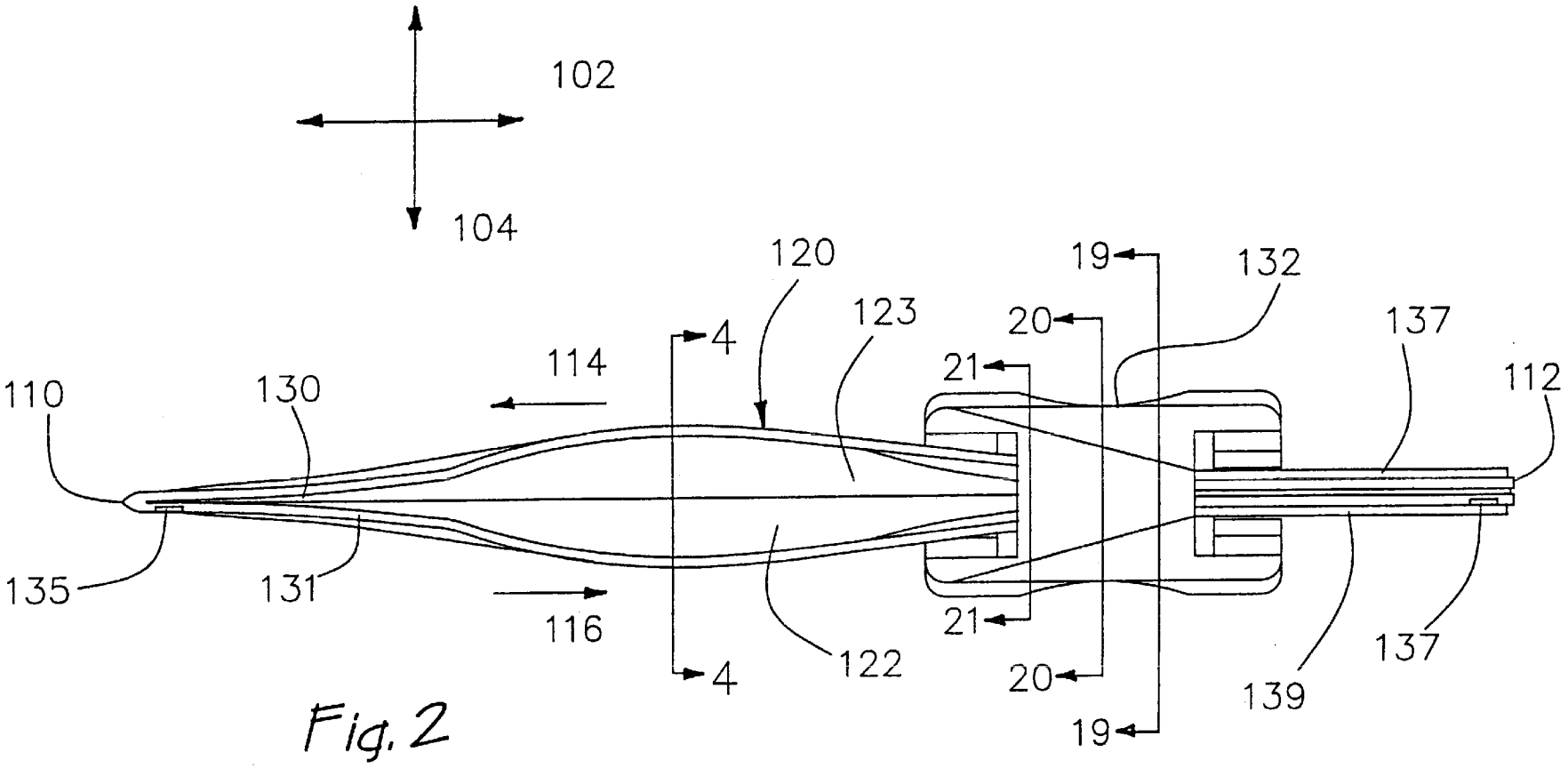
FIG. 2 is a top view of the container in FIG. 1.

FIGS. 1 and 2 illustrate a container in the form of a plastic bag 120 having a sealable closure device 121. The bag 120 includes side walls 122, 123 joined at seams 125, 126 to form a compartment sealable by means of the closure device 121. The closure device 121 comprises first and second fastening strips 130, 131 and a slider 132. The closure device 121 also includes first and second detents 135, 137 along the outside of the fastening strips 130, 131.

The fastening strips 130, 131 and the slider 132 have a longitudinal X axis 102 and a transverse Y axis 104 which is perpendicular to the longitudinal X axis 102. Also, the fastening strips and slider have a vertical Z axis 106 which is perpendicular to the longitudinal X axis 102 and the vertical Z axis is perpendicular to the transverse Y axis 104.

In use, the slider 132 of the present invention facilitates the occlusion and deocclusion of the interlocking fastening strips 130, 131 when moved in the appropriate direction along the longitudinal X axis 102 of the fastening strips 130, 131. In particular, the slider 132 facilitates the occlusion of the interlocking fastening strips 130, 131 when moved towards a first end 110 thereof, and facilitates the deocclusion of the interlocking fastening strips 130, 131 when moved towards a second end 112 thereof. When the slider 132 is moved in an occlusion direction, as indicated by reference numeral 114 in FIGS. 1 and 2, closure of the fastening strips 130, 131 occurs. Conversely, when the slider 132 is moved in a deocclusion direction, as indicated by reference numeral 116, separation of the fastening strips 130, 131 occurs.

Figure 3:
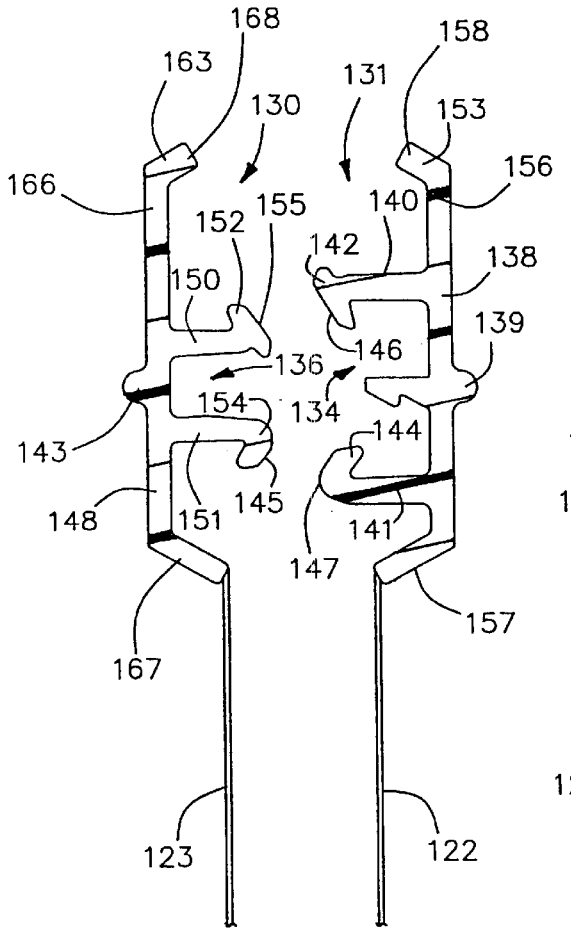
FIG. 3 is a partial cross-sectional view of the fastening strips taken along line 4—4 in FIG. 2.
Figure 4:
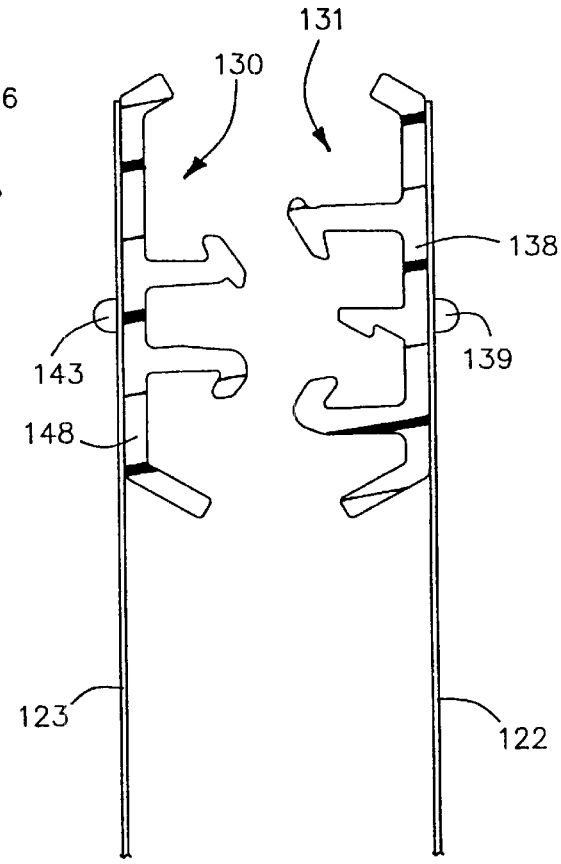
FIG. 4 is a partial cross-sectional view showing another embodiment of attaching the fastening strips to the side walls of the container.

An illustrative example of the type of closure device that may be used with the present invention is shown in FIG. 3. The fastening strips include a first fastening strip 130 with a first closure element 136 and a second fastening strip 131 with a second closure element 134. The first closure element 136 engages the second closure element 134. The first fastening strip 130 may include an upper flange 163 disposed at the upper end of the first fastening strip 130 and a lower flange 167 disposed at the lower end of the first fastening strip 130. Likewise, the second fastening strip 131 may include an upper flange 153 disposed at the upper end of the second fastening strip 131 and a lower flange 157 disposed at the lower end of the second fastening strip 131. The upper flanges 163, 153 include a straight portion 166, 156 and an angled portion 168, 158. The angled portion 168, 158 is at an approximately 120 degree angle to the straight portion 166, 156. As shown in FIG. 3, the side walls 122, 123 of the plastic bag 120 may be attached to the lower flanges 167, 157 of their respective fastening strips 130, 131 by conventional manufacturing techniques. As shown in FIG. 4, the side walls 122, 123 of the bag 120 may also be attached to the outside surfaces of their respective fastening strips 130, 131.

Referring to FIGS. 3 and 4, the second closure element 134 includes a base portion 138 having a pair of spaced-apart parallely disposed webs 140, 141, extending from the base portion 138. The webs 140, 141 include hook closure portions 146, 144 extending from the webs 140, 141 respectively, and facing towards each other. The hook closure portions 146, 144 include guide surfaces 142, 147 which serve to guide the hook closure portions 146, 144 for occluding with the hook closure portions 152, 154 of the first closure element 136.

The first closure element 136 includes a base portion 148 including a pair of spaced-apart, parallely disposed webs 150, 151 extending from the base portion 148. The webs 150, 151 include hook closure portions 152, 145 extending from the webs 150, 151 respectively and facing away from each other. The hook closure portions 152, 145 include guide surfaces 154, 155 which generally serve to guide the hook closure portions 152, 145 for occlusion with the hook closure portions 142, 144 of the second closure element 134. The guide surfaces 154, 155 may also have a rounded crown surface. In addition, the hook closure portions 144, 145 may be designed so that the hook closure portions 144, 145 adjacent the interior of the container provide a greater resistance to opening the closure device 121.

As shown in FIGS. 1, 3 and 4, the base portions 138, 148 of the closure elements 134, 136 also have respective guide rails 139, 143 on the sides opposite the hook closure portions 140, 141, 150, 151 that extend lineally along the longitudinal X axis 102. As shown in FIG. 3, the rails 139, 143 may be integrally formed with the closure elements 134, 136. As shown in FIG. 4, the rails 139, 143 may also be formed as an outward ridge on the surface of the bag sidewalls 122, 123 by conventional manufacturing techniques. In both embodiments of FIGS. 3 and 4, the guide rails 139, 143 are spaced apart in the vertical Z axis between the topmost and lower most hook closure portions. In this embodiment, the topmost and lowermost closure portions 140, 141 are provided by the second closure element 131.

Figure 6:
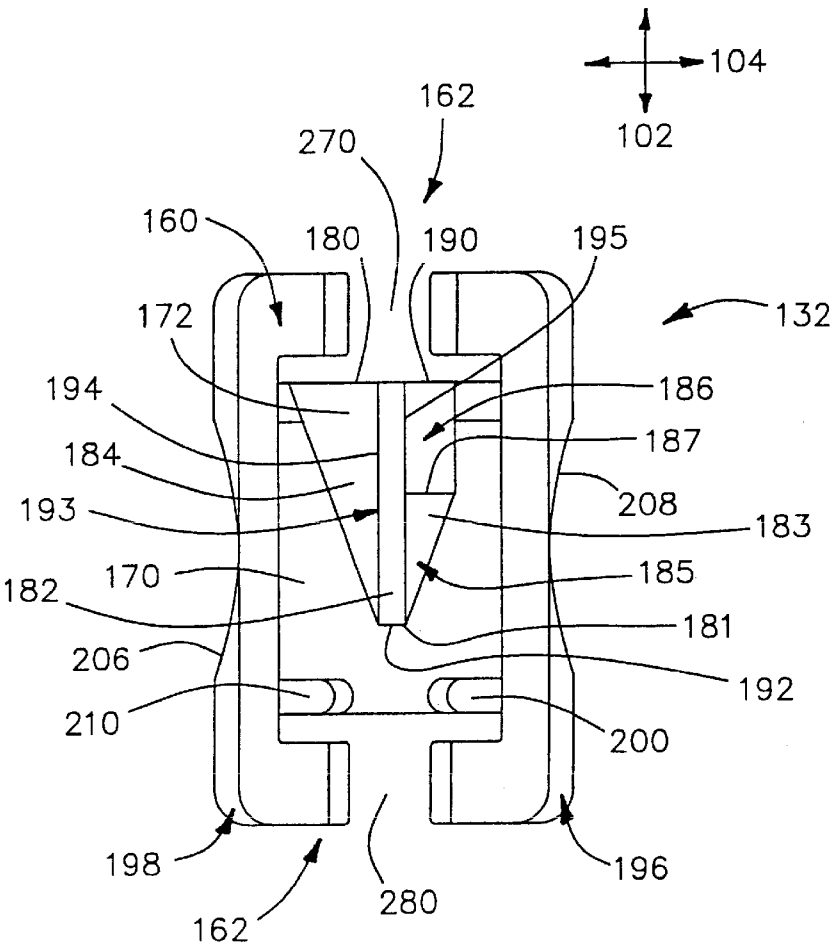
FIG. 6 is a bottom view of the slider in FIG. 2.

Referring to FIGS. 5–12, the slider 132 includes a housing 160 and an attaching means 162. The housing 160 may include a top portion 170, a first side portion 174, and a second side portion 176. The top portion 170 provides a separator 172 having a first end 190 and a second end 192 where the first end 190 is wider than the second end 192. The separator 172 is generally triangular in shape as shown in FIG. 6.

Figure 8:
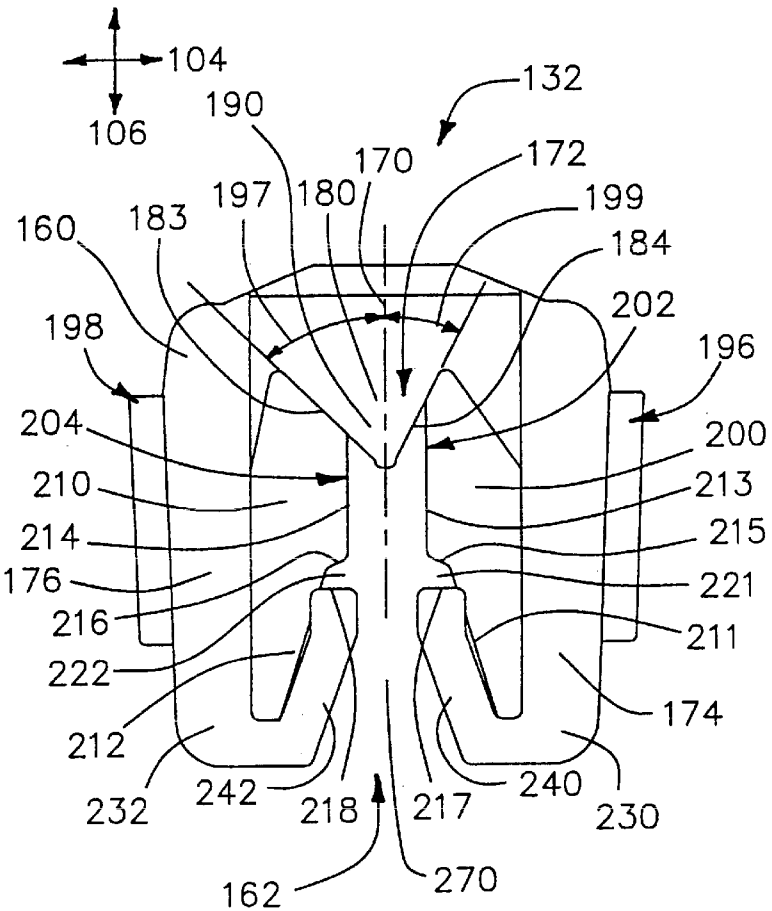
FIG. 8 is a front view of the slider in FIG. 2.
Figure 7:
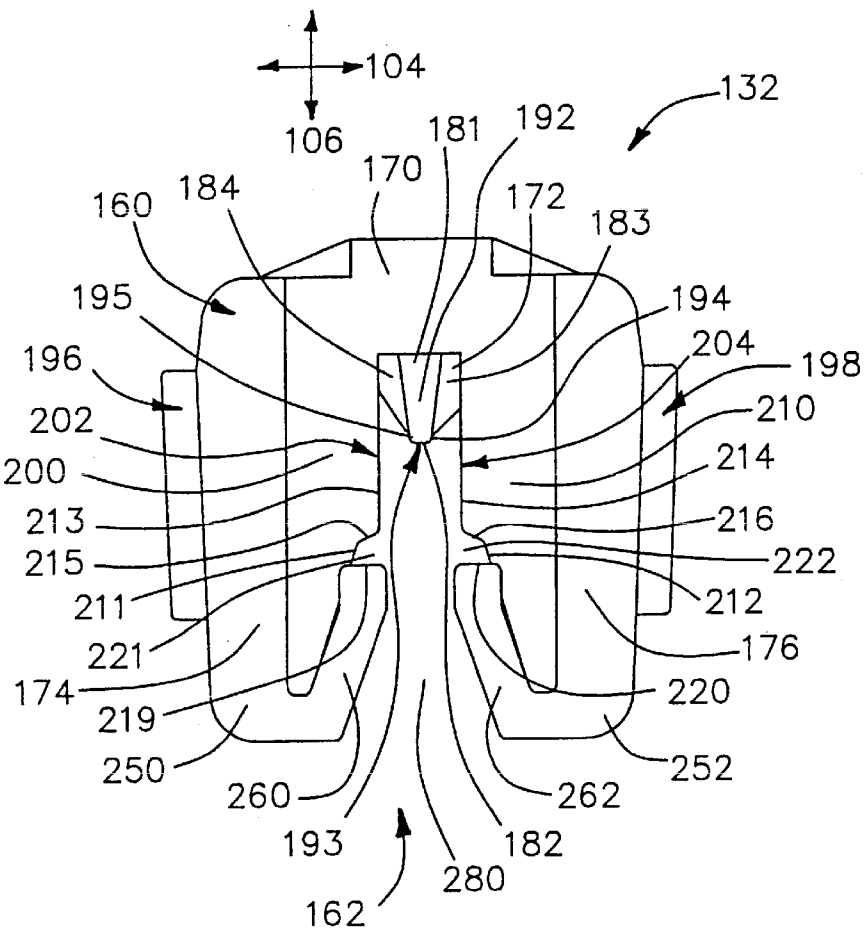
FIG. 7 is a rear view of the slider in FIG. 2.
Figure 9:
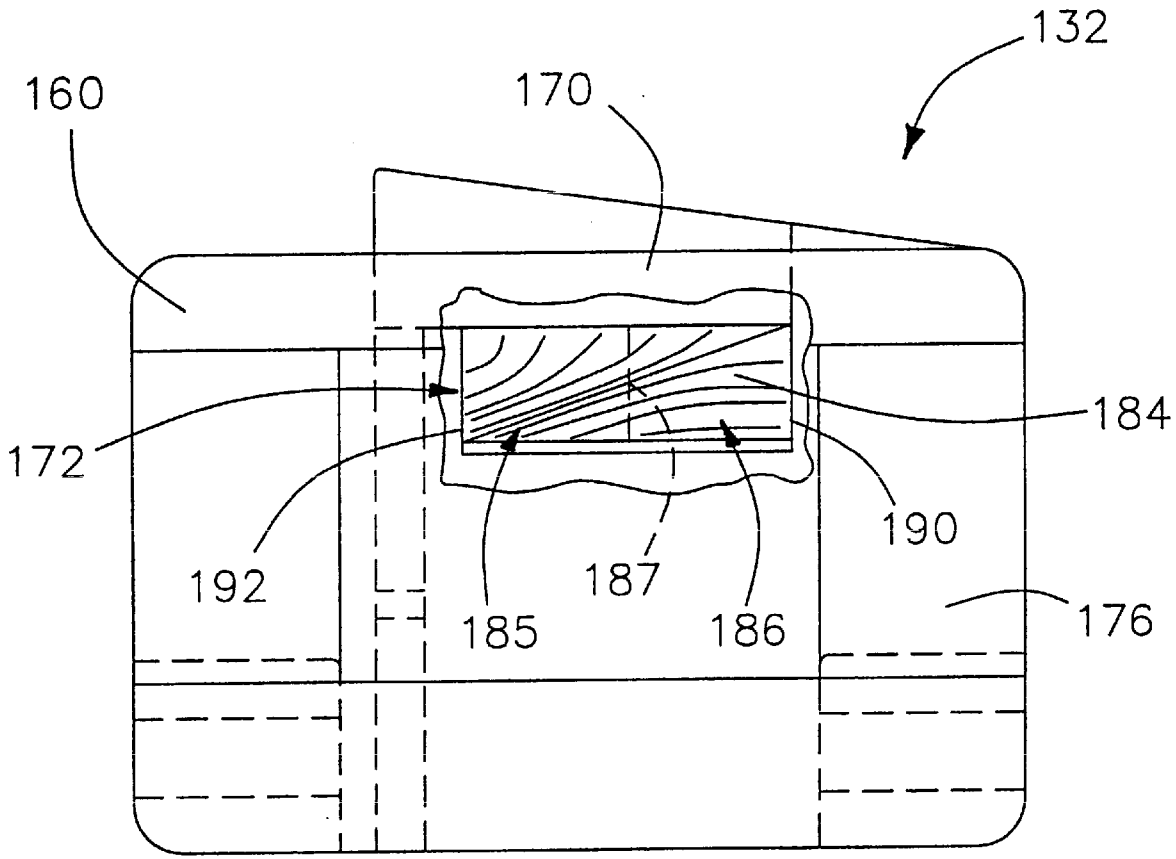
FIG. 9 is a left side view of the slider in FIG. 2 with a fragmentary section cut away to expose the separator.
Figure 10:
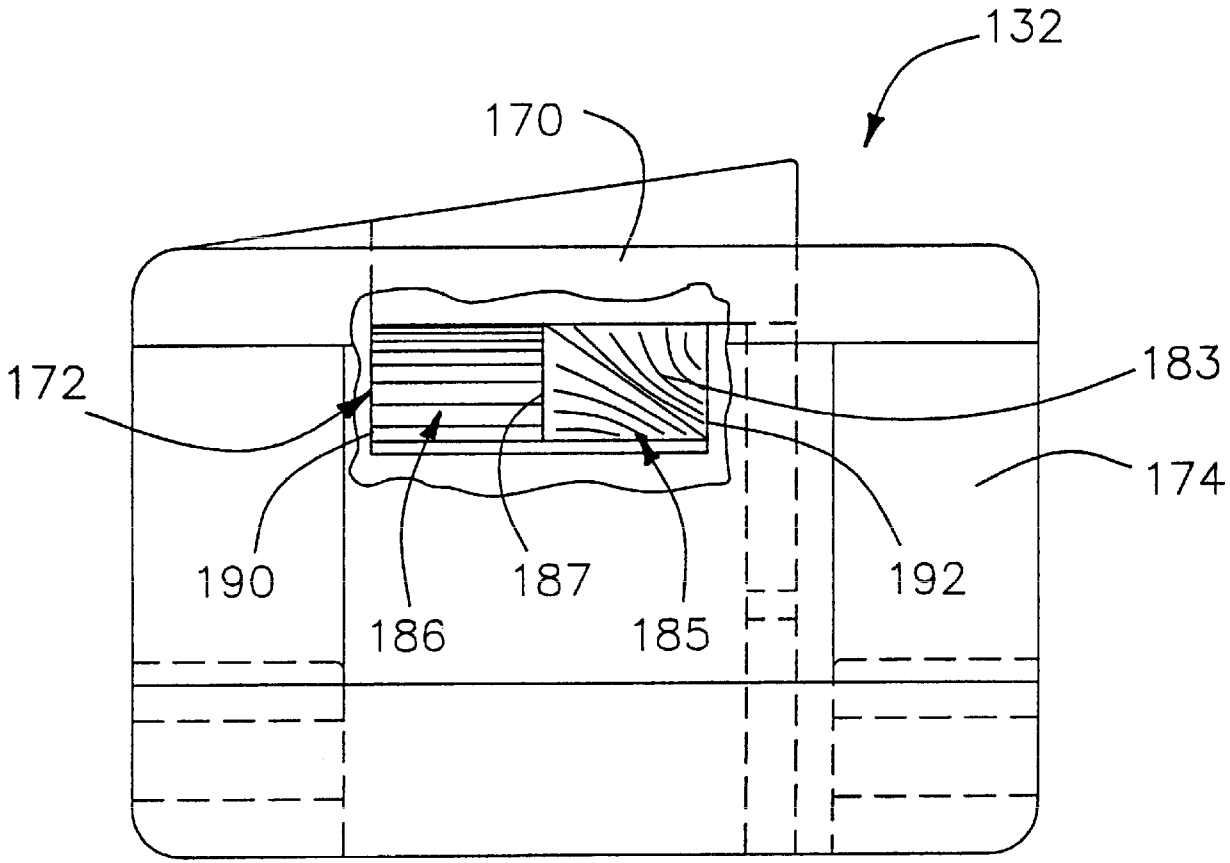
FIG. 10 is a right side view of the slider in FIG. 2 with a fragmentary section cut away to expose the separator.

Referring to FIGS. 7 and 8, the separator 172 has a first surface 180 at the first end 190 and a second surface 181 at the second end 192. The separator 172 has a bottom surface 182. In this embodiment, a raised ridge 193 provides a horizontal bottom surface 182 parallel with the X axis 102 with side surfaces 194, 195. Also, the separator 172 has a first side wall 183 and a second side wall 184 as shown in FIGS. 6–8. The side walls 183, 184 generally angle inwardly from the first end 190 to the second end 192. The side walls 183, 184 also angle outwardly from the bottom surface 182 to the top portion 170 as shown in FIGS. 7 and 8.

As seen best in FIG. 6, the separator 172 includes adjacent forward and rearward portions 185, 186 of the angled side walls 183, 184. The rearward portion 186 terminates at the first end 190 and merges into the forward portion 185 at a break line 187. The forward portion 185 terminates at the second end 192. The second side wall 184 angles continuously inward from the first end 190 to the second end 192. The first side wall 183 only angles inward on the forward portion 185, from the break 187 to the second end 192. The rearward portion 186 of the first side wall 183 extends parallel with the X axis 102 and does not angle inwardly or outwardly as shown in FIG. 6. Referring to FIG. 8, the first side wall 183 intersects the wider first end 190 at an angle 197 greater than an angle 199 that the second sidewall 184 intersects the wider first end 190. In this embodiment, the angle 197 is approximately 45° and the angle 199 is approximately 27°.

Figure 18:
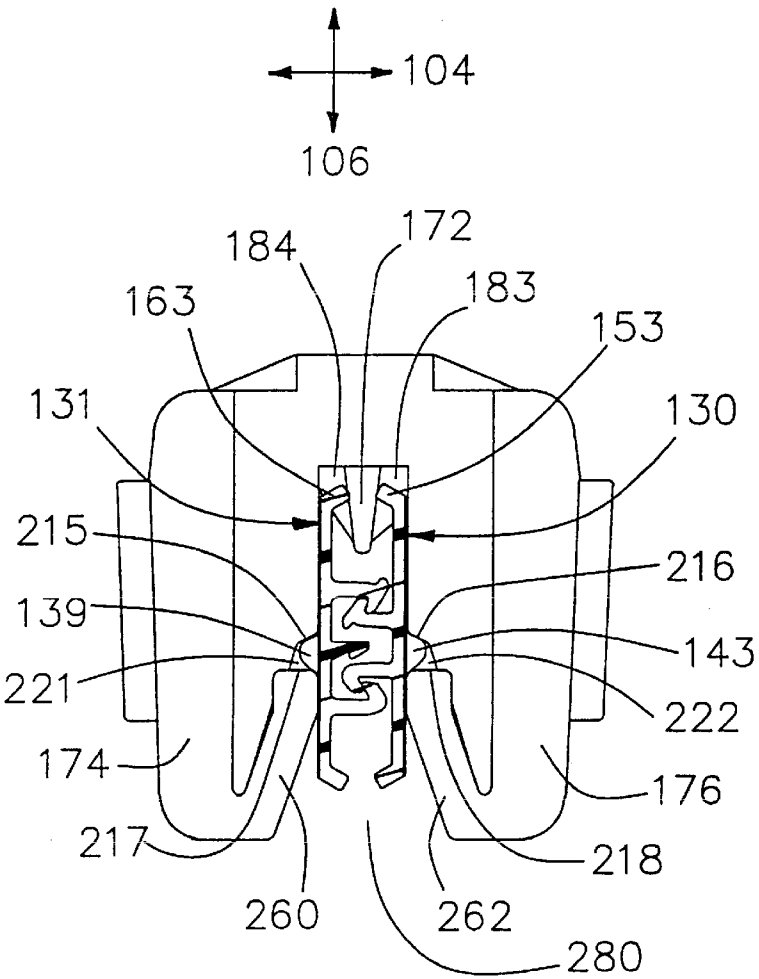
FIG. 18 is a cross-sectional view taken along line 18—18 in FIG. 13 and illustrates the slider fully attached to the fastening strips.

The top portion 170 of the slider merges into the first side portion 174 and the second side portion 176. The first side portion 174 has a first grip 196 and a first occlusion member 200. Similarly, the second side portion 176 has a second grip 198 and a second occlusion member 210. The first grip 196 and the Second grip 198 extend laterally along the outer surfaces of the side portions 174, 176 and provide inwardly protruding radial gripping surfaces 206, 208 designed to correspond to the contour of a person's fingertips as viewed in FIGS. 5 and 6. The radial surfaces 206, 208 facilitate grasping the slider 132 during occlusion or deocclusion of the fastening strips 130, 131. As shown in FIG. 18, the side portions 174, 176 straddle the fastening strips 130, 131 when inserted thereon, with the occlusion members 200, 210 engaging the fastening strips 130, 131.

The occlusion members 200, 210 oppose one another and force the fastening strips 130, 131 together to effectuate occlusion of the fastening strips 130, 131 when the slider is moved in the occlusion direction 114. The top portion 170 may be thick to provide reinforcement between the occlusion members 200, 210 to prevent the side portions 174, 176 from flexing during use. The occlusion members 200, 210 extend inward in the Y axis 104 from the side portions 174, 176 of the slider 132 towards the center of the slider. As viewed in FIGS. 7 and 8, the occluding members 200, 210 have inner surfaces 202, 204 which generally angle outwardly from the top portion 170 to the bottom of the slider 132 thus forming a V-shape. The inner surfaces 202, 204 also have differently angled portions, with respective lower portions 211, 212 that are angled more with respect to the Z axis 106 than respective upper portions 213, 214. In this embodiment, the upper surface portions 213, 214 are substantially parallel with the Z axis 106 as shown in FIGS. 7 and 8. Each inner surface 202, 204, also provides a guide surface 215, 216, that offsets the lower and upper portions 211, 212, 213, 214.

Figure 5:
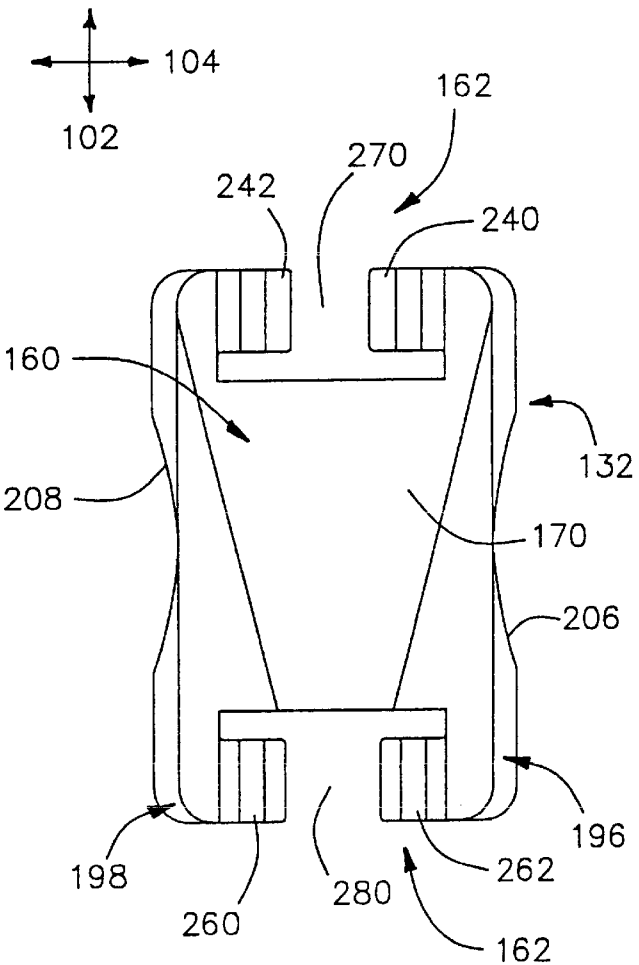
FIG. 5 is a top view of the slider in FIG. 2.

The attaching means 162 includes a pair of front flexible shoulders 230, 232, a pair of front legs 240, 242, a pair of rear flexible shoulders 250, 252, and a pair of rear legs 260, 262. As viewed in FIG. 8, the first side portion 174 merges into the first front leg 240 through the first front shoulder 230. Likewise, the second side portion 176 merges into the second front leg 242 through the second front shoulder 232. The front legs 240, 242 angle inwardly in the transverse Y axis 104 thereby forming a front slot 270 of substantially uniform width as seen in FIGS. 5 and 6.

Similarly, as viewed in FIG. 7, the first side portion 174 merges into the first rear leg 260 through the first rear shoulder 250. Also, the second side portion 176 merges into the second rear leg 262 through the second rear shoulder 252. The rear legs 260, 262 angle inwardly in the transverse Y axis 104 thus forming a rear slot 280 of substantially uniform width. In a relaxed state, the legs 240, 242, 260, 262 of the slider 132 angle inwardly away from their respective side portions 174, 176 to form a void volume through which the legs 240, 242, 260, 262 may move outwardly in the transverse Y axis 104 during attachment of the slider 132 onto the fastening strips 130 131.

Figure 17:
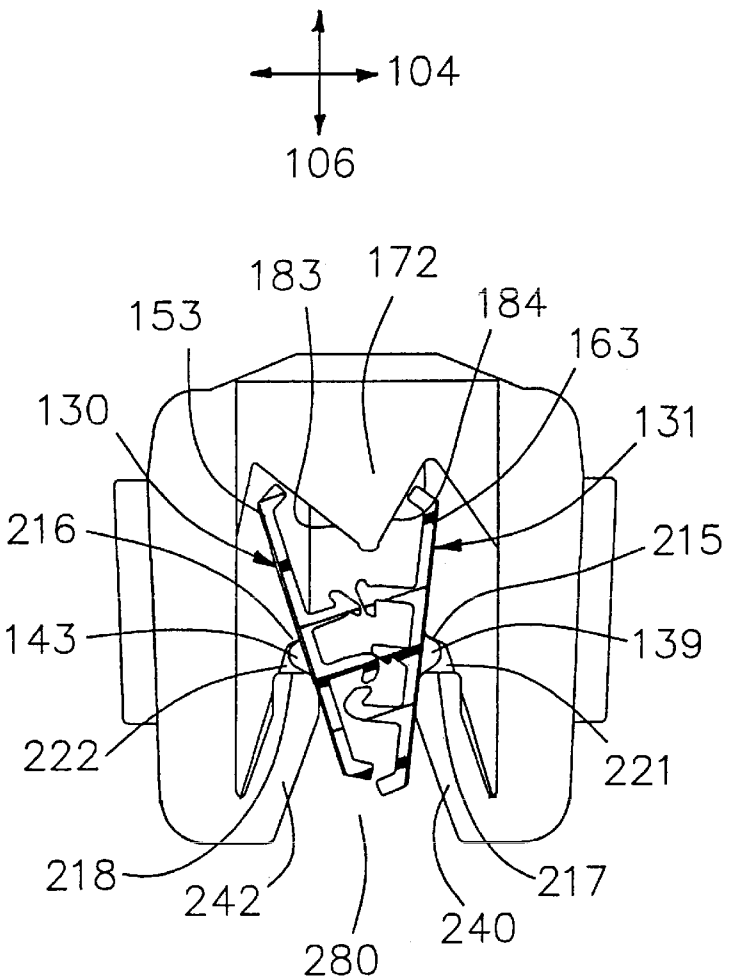
FIG. 17 is a cross-sectional view taken along line 17—17 in FIG. 13 and illustrates the slider fully attached to the fastening strips.

Each of the legs 240, 242, 260, 262 also provides a respective guide surface 217, 218, 219, 220 at their uppermost terminating end surface. The combination of the guide surfaces 215, 216 of the occlusion members 200, 202 and the guide surfaces 217, 218, 219, 220 of the legs 240, 242, 260, 262 form a pair of parallel guide tracks 221, 222 in the housing 160. In this embodiment, the guide tracks 221, 222 appear as a pair of channels when viewed from the front and rear in FIGS. 7 and 8. As shown in FIGS. 17 and 18, the guide tracks 221, 222 slidably engage the guide rails 139, 143 when the slider 132 is attached on the fastening strips 130, 131.

An attaching means is provided to attach the slider 132 to the fastening strips 130, 131 in the vertical Z axis 106 while preventing the slider 132 from being removed from the fastening strips 130, 131 in the vertical Z axis 106 thereafter. It will be appreciated by those skilled in the art that the slider 132 may be molded from any suitable plastic material.

FIGS. 11–13 sequentially illustrate the attachment of a slider 132 made in accordance with the present invention onto the fastening strips 130, 131 of a plastic bag 120 in the vertical Z axis 106. FIG. 11 represents the slider 132 positioned directly over the fastening strips 130, 131. FIG. 12 illustrates the slider as it is moved downwardly in the vertical Z axis 106 and positioned onto the fastening strips 130, 131. FIG. 13 shows the slider 132 as it is moved further in the vertical Z axis 106 and represents the slider 132 fully attached to the fastening strips 130, 131 of the plastic bag 120.

FIGS. 14–18 sequentially illustrate the attachment of the slider 132 onto the fastening strips 130, 131 in the vertical Z axis 106. Although the following description will be limited to the slider components illustrated in the respective view described, it will be appreciated that the other slider components will function in a similar fashion. For example, the front legs 240, 242 of the slider 132 will operate in the same fashion as the rear legs 260, 262 of the slider 132 during attachment of the slider 132 onto the fastening strips 130, 131.

Figure 15:
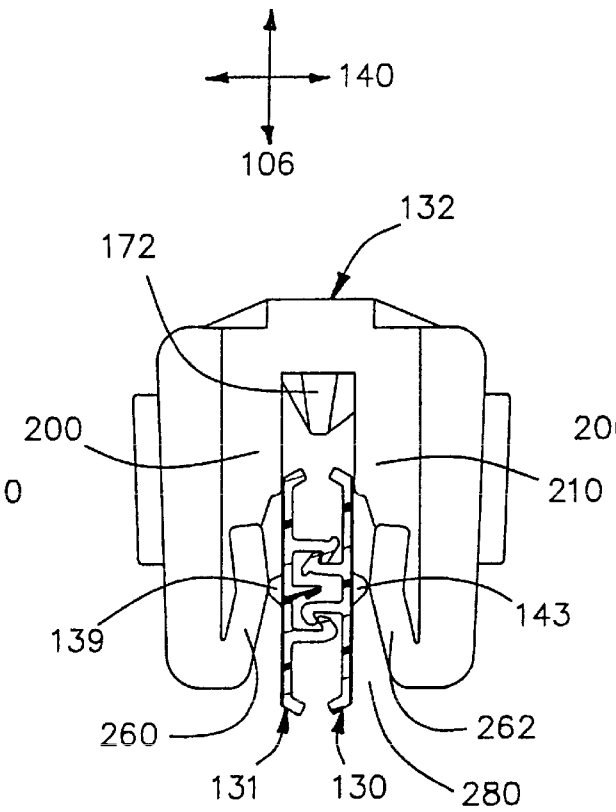
FIG. 15 is a cross-sectional view taken along line 15—15 in FIG. 12 and illustrates the respective positions of the slider to the fastening strips as the slider is positioned onto the fastening strips.
Figure 14:
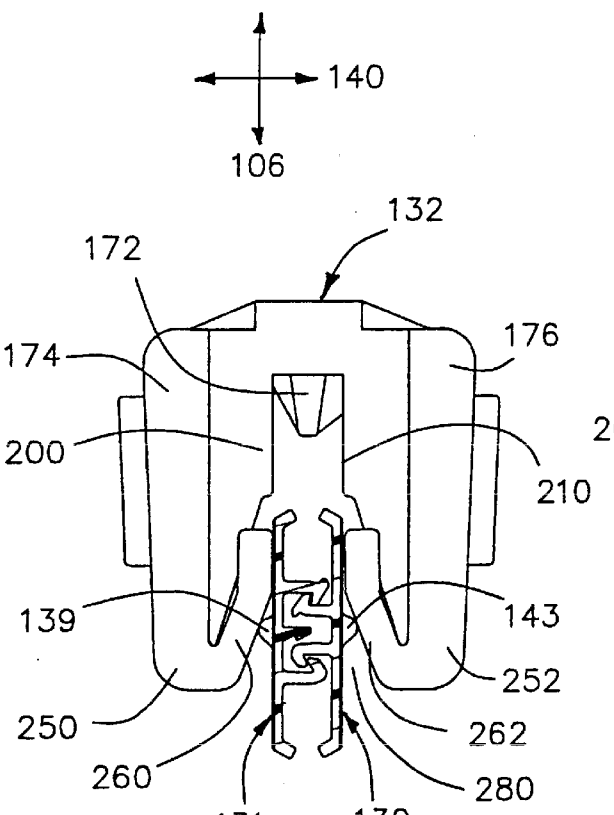
FIG. 14 is a cross-sectional view taken along line 14—14 in FIG. 11 and illustrates the slider positioned above the fastening strips.

FIG. 14 depicts occluded fastening strips 130, 131 and a slider 132 having first and second rear legs 260, 262 in a relaxed position. The occluded fastening strips 130, 131 are immediately below the rear slot 280. Referring to FIG. 15, the slider 132 is moved in the vertical Z axis 106 toward the fastening strips 130, 131.

The fastening strips 130, 131 engage the rear legs 260, 262 and deflect the legs 260, 262 outwardly in the transverse Y axis 104 toward their respective side portions 174, 176 thus widening the rear slot 280. The fastening strips 130, 131 are guided into the slider 132 by the tapered surfaces of the occlusion members 200, 210.

Figure 16:
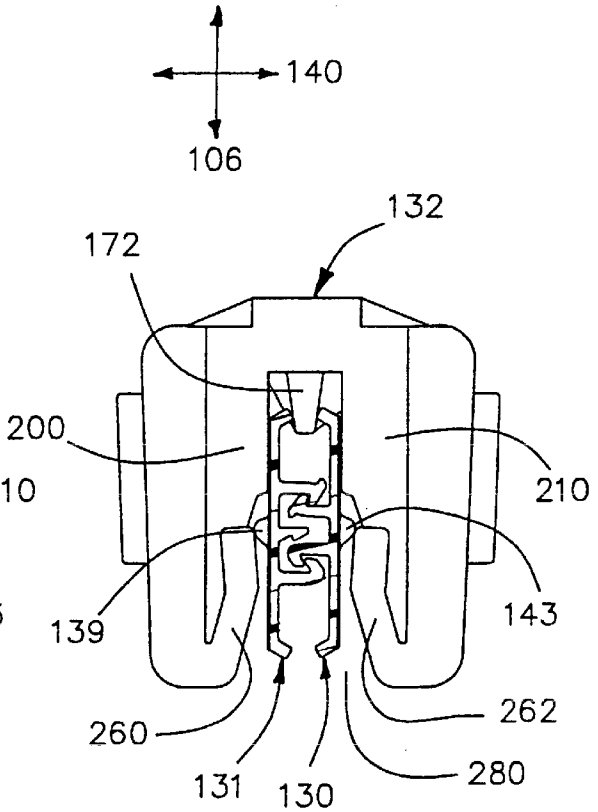
FIG. 16 is a rear view of the slider and cross-sectional view of the fastening strips and illustrates their respective positions to one another as the slider is positioned onto the fastening strips.

FIG. 16 illustrates the fastening strips 130, 131 moving through the rear slot 280. The separator 172 begins to penetrate between the flanges 153, 163 of the fastening strips 130, 131.

As shown in FIGS. 17 and 18, upon further movement of the fastening strips 130, 131 toward the slider 132 in the vertical Z axis 106, the fastening strips 130, 131 project through the legs 260, 262, and the legs 260, 262 retract back to their relaxed position. Likewise, the width of the rear slot 280 returns to its relaxed position width. The guide rails 139,

143 project into the guide tracks 221, 222 and slidably engage the various guide surfaces 215, 216, 217, 218, 219, 220. With respect to the fastening strips 130, 131, the separator 172 is forced between the flanges 153, 163 of the occluded fastening strips 130, 131. The first end 190 of the separator 172, the wider end, is forced between and effectively deoccludes the fastening strips 130 , 131 as illustrated in FIG. 21.

FIGS. 17 and 18 represent the attached position of the slider 132 on fastening strips 130, 131. As illustrated in FIG. 18, once the legs 260, 262 return to their relaxed position , the fastening strips 130, 131 no longer fit through the slot 280. The legs 260, 262 effectuate attachment of the slider 132 onto the fastening strips 130, 131 in the vertical Z ax is 106 while preventing removal of the slider 132 from the fastening strips 130, 131 in the vertical Z axis 106 after the slider 132 has been attached to the fastening strips 130, 131. In the event removal of the slider 132 in the vertical Z axis 106 is attempted, the legs 260, 262 will provide resistance against removal of the slider 132. The legs 260, 262 retain the slider 132 on the fastening strips 130, 131 by resisting vertical Z axis 106 movement of the fastening strips 130, 131 through the slot 280. More specifically, the legs 260, 262 are angled upwardly and inwardly so that during insertion of the slider 132 onto the fastening strips 130, 131 the legs 260, 262 deflect outwardly in the transverse Y axis 104 to increase the width of the slot 280 and permit the passage of the fastening strips 130, 131. When attempting to remove the slider 132 from the fastening strips 130, 131 in the vertical Z axis 106, the guide rails 139, 143 of the fastening strips 130, 131 contact the legs 260, 262 and deflect the legs 260, 262 inwardly in the transverse Y axis 104. Thus, the width of the slot 280 is reduced. The rigidity of the legs 260, 262 and shoulders 250, 252 will resist inward movement of the legs 260, 262. As a result, the slider 132 may only be removed from the fastening strips 130, 131 in the vertical Z axis 106 by either tearing through the fastening strips 130, 131 or breaking and/or by deforming the legs 260, 262 of the slider 132.

Figure 21:
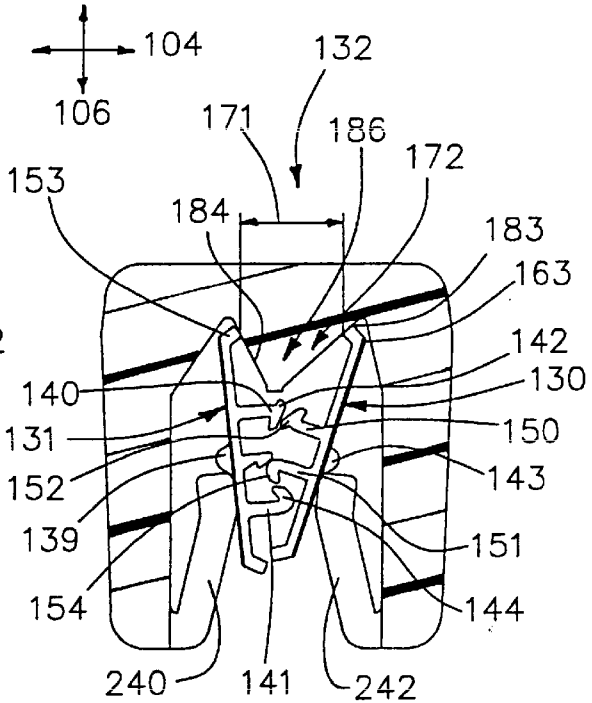
FIG. 21 is a cross-sectional view taken along line 21—21 in FIG. 2.
Figure 20:
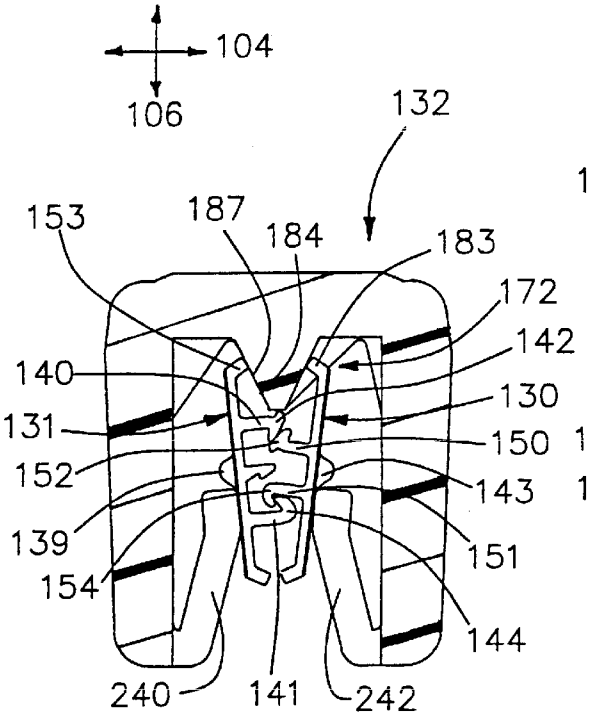
FIG. 20 is a cross-sectional view taken along line 20—20 in FIG. 2.
Figure 19:
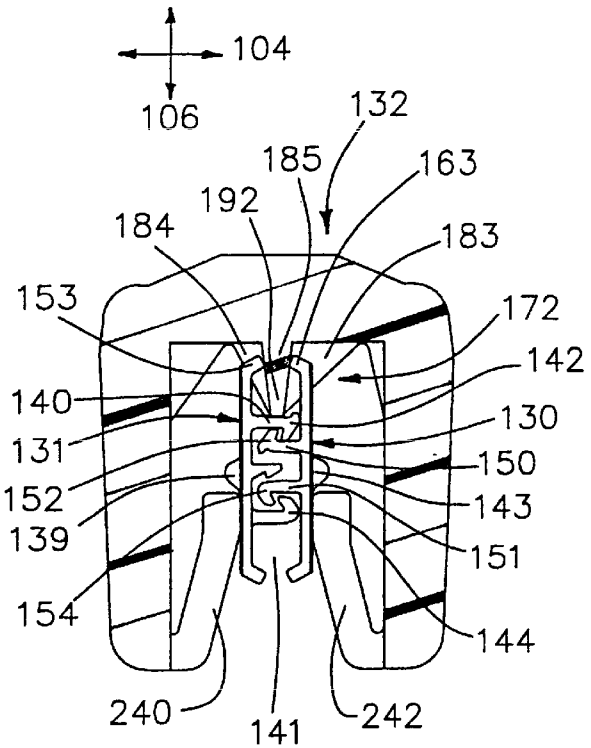
FIG. 19 is a cross-sectional view taken along line 19—19 in FIG. 2.

FIGS. 19–21 illustrate the fastening strips 130, 131 at different locations along the slider 132 as shown in FIG. 2. FIG. 19 depicts the fastening strips 130, 131 at a location near the second end 192 (the narrow end) of the separator 172. The separator 172 is located between the flanges 153, 163 of the fastening strips 130, 131. At this location, the upper webs 140, 150 and the lower webs 141, 151 are occluded. FIG. 20 illustrates the fastenings strips 130, 131 at a location near the middle of the separator 172 and more specifically near the break line 187. The width of the separator 172 at this location forces the upper ends of the fastening strips 130, 131 apart from one another about equally in the transverse Y axis 104 and the upper webs 140, 150 of the fastening strips 130, 131 are deoccluded. The upper webs 140, 150 and hook closure portions 142, 152 deocclude by deflecting as they move past each other. Specifically, web 140 may deflect upward in the vertical Z axis 106 and/or the hook closure portion 142 may deflect outward in the transverse Y axis 104. Similarly, the web 150 may deflect downward in the vertical Z axis 106 and/or the hook closure portion 152 may deflect outward in the transverse Y axis 104. FIG. 21 shows the fastening strips 130, 131 near the first end 190 (the wide end) of the separator 172. At this position, the width of the separator 172 deoccludes both the upper webs 140, 150 and the lower webs 141, 151 of the fastening strips 130, 131. The lower webs 141, 151 and hook closure portions 144, 154 deocclude by pivoting on the guide rails 139, 143 and shearing the hook closure portions 144, 154 past each other in the vertical Z axis 106 as shown in FIGS. 19–21.

The separator 172 translates the flanges 163, 153 of the fastening strips 130, 131 horizontally outward from one another in the Y axis 104 at different rates of movement to facilitate easier deocclusion between interlocked webs 140, 141, 150, 151. The different rates of movement is accomplished through the rearward portion 186 of the separator 172. The forward portion 185 of the separator 172 drives the flanges 153, 163 of fastening strips 130, 131 substantially horizontally outward from one another at about the same rate to about the same distance from the position in FIG. 19 to that in FIG. 20. The rearward portion 186 of the separator 172 translates the flange 163 of the first fastening strip 130 further in the Y axis 104, while holding the position of the flange 153 of the second fastening strip 131 stationary, from the position shown in FIG. 20 to that shown in FIG. 21. The rearward portion 186 continues to move the flange 163 of the first fastening strip 130 at a rate which is about equal to the rate of movement caused by the forward portion 185. The rearward portion 186 displaces the flange 163 about twice the distance in the Y axis 104 compared to the displacement of the flange 153 of the other fastening strip 131.

The guide rails 139, 143 each provide an approximate pivot point about which the flanges 153, 163 of the fastening strips translate to move horizontally outward. The separator 172 pivots the flange 163 of the first fastening strip 130 about 15° relative to the Z axis 106 while the flange 153 of the second fastening strip 131 is pivoted about 7°, as seen in FIG. 21. Because the guide rails 139, 143 or pivot points are above the lower web members 141, 151 of the fastening strips 130, 131, the lower web member 141, 151 translate inward in the Y axis 104 from the position of FIG. 19 through that in FIG. 20 to the position in FIG. 21. The upper web members 140, 150 move past each other by deflecting. The lower web members 141, 151 are pivoted and shear past one another in the vertical Z axis 106 as shown in FIGS. 19–21. This pivoting action also reduces the mount of bending and deflecting by the lower web members.

An advantage of disposing the guide rails 139, 143 above the bottom web members 139, 143 is that the slider 132 is more compact. Specifically, the first and second side wall portions 174, 176 of the slider 132 can be shorter.

The angled portions 168, 158 of the flanges 153, 163 facilitate the deocclusion of the fastening strips and allows the use of a narrower separator 172. Specifically, the angled portions contact the separator 172 to deocclude the fastening strips 130, 131. Because the angled portions 168, 158 extend inwardly to engage the separator 172, the separator can have a width 171 to achieve deocclusion of the fastening strips as shown in FIG. 21. If the angled portions were not used and the separator contacted only the straight portions, then the separator would need to have a width greater than width 171 in order to achieve deocclusion, assuming all other dimensions and parameters are the same.

Figure 23:
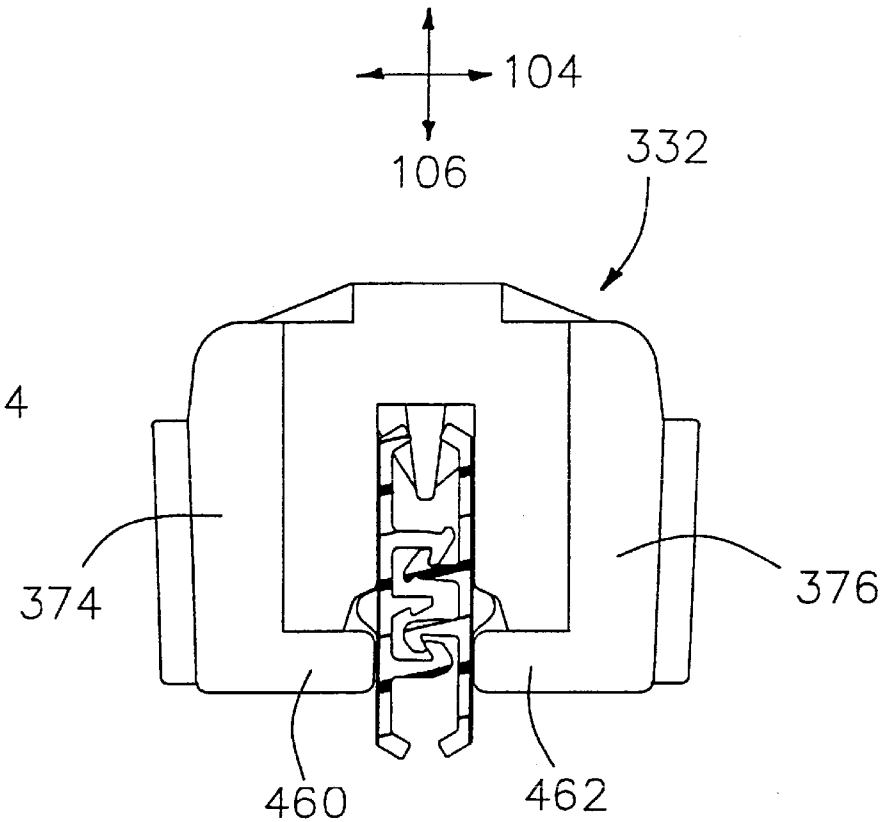
FIG. 23 is an end view of the embodiment shown in FIG. 22.
Figure 22:
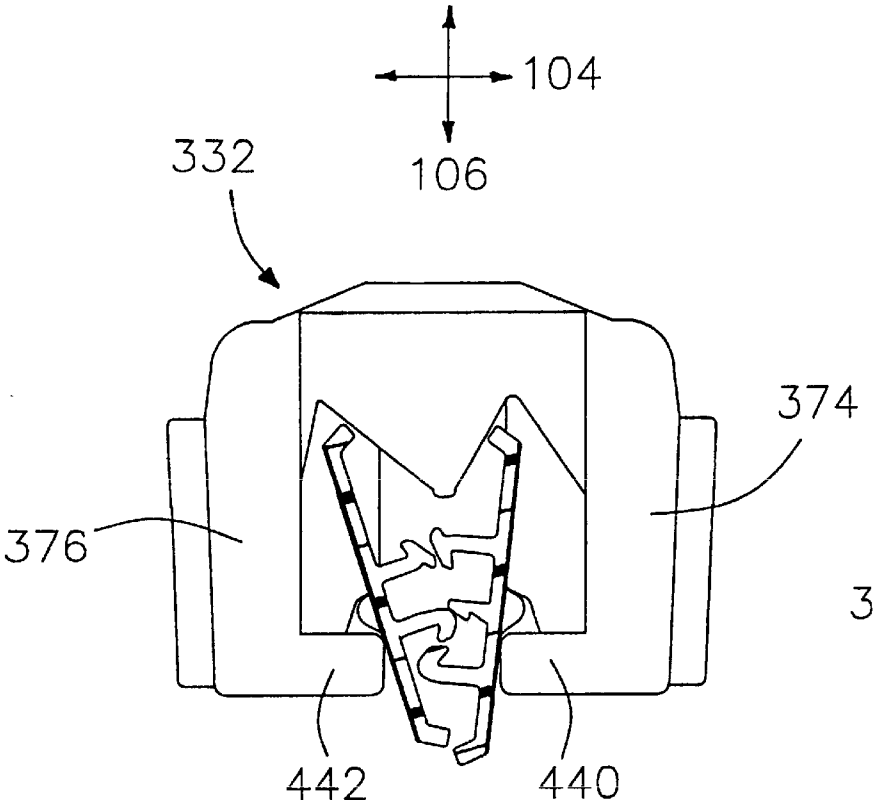
FIG. 22 is an end view of another embodiment of the slider.

The slider of the present invention may incorporate several configurations. Referring to FIGS. 22 and 23, another embodiment of the slider is shown. The slider 332 is similar to slider 132. However, slider 332 has relatively rigid legs or shoulders 440, 442, 460, 462 in comparison to legs 240, 242, 260, 262. The slider 332 can be assembled to the fastening strips by spreading the side portions 374, 376 or by assembling the slider 332 from separate components. The slider 332 occludes and deoccludes the fastening strips in the same manner as slider 132.

The interlocking fastening strips may be manufactured by extrusion through a die. In addition, the fastening strips may be manufactured to have approximately uniform cross-sections. This not only simplifies the manufacturing of a closure device, but also contributes to the physical flexibility of the closure device.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. In most instances, the fastening strips are made from low density polyethylene. The selection of the appropriate thermoplastic material, however, is related to the particular design of the fastening strips, the Young's Modulus of the thermoplastic material, and the desired elasticity and flexibility of the strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. In most instances, the bag is made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the closure device or expected additional manufacturing operations.

Generally, the closure device can be manufactured in a variety of forms to suit the intended use. The closure device may be integrally formed on the opposing side walls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene). The selection of the material may be determined by the characteristics to be achieved by the slider.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention. In addition, all references and copending applications cited herein are hereby incorporated by reference in their entireties.

What is claimed is:

1. A closure device comprising:

a first fastening strip;

a second fastening strip arranged to be interlocked over a predetermined longitudinal X axis with said first fastening strip, the first and second fastening strips each having upper and lower ends disposed along a vertical Z axis perpendicular to the X axis, said fastening strips having a Y axis perpendicular to the Z and X axes;

a slider slidably engaging said first and second fastening strips, said slider facilitates the occlusion of said fastening strips when moved towards a first end of said fastening strips; and said slider including a housing having a separator for deocclusion of said fastening strips, the first fastening strip has a first pivot point between the upper end and the lower end, the separator pivoting the upper end and the lower end about the pivot point to facilitate deocclusion wherein said lower end of the first fastening strip includes a lower interlocking web member and said upper end of said first fastening strip includes an upper interlocking web member, said first pivot point disposed between said upper and lower interlocking web members and wherein the first fastening strip includes a first guide rail extending in the longitudinal X axis, the slider includes a corresponding guide track slidably engaging said first guide rail.

2. The closure device of claim 1 wherein said web members include hooks.

3. The closure device of claim 1 wherein the first guide rail is disposed between said upper and lower interlocking members.

4. The closure device of claim 1 wherein the second fastening strip has a second pivot point between the upper end and the lower end, the separator pivoting the upper and lower ends of each fastening strip about the second pivot point in opposing directions to facilitate deocclusion and wherein said lower end of the second fastening strip includes a lower interlocking web member and said upper end of said second fastening strip includes an upper interlocking web member, said second pivot point disposed between said upper and lower interlocking web members and wherein the second fastening strip includes a second guide rail extending in the longitudinal X axis, the slider includes corresponding guide tracks slidably engaging said second guide rail.

5. The closure device of claim 1 wherein said web members include hooks wherein hooks of said first fastening strip engage hooks of said second fastening strip.

6. The closure device of claim 4 wherein the guide rails are disposed between said upper and lower interlocking members.

7. The closure device of claim 4 wherein said separator pivots the second fastening strip about 7 degrees and said first fastening strip about 15 degrees.

8. A closure device comprising:

first and second interlocking fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, a slider which slidably engages said first and second fastening strips, said slider facilitates the occlusion of said fastening strips when moved towards a first end of said fastening strips and deocclusion of said fastening strips when moved toward a second end of said fastening strips, said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded, the first web deflects during deocclusion of said fastening strips, said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, said third closure portion and said fourth closure portion shear during deocclusion of said fastening strips wherein shearing occurs when the first fastening strip pivots relative to the second fastening strip wherein the first fastening strip has a first pivot point, the separator pivoting the upper and lower ends about the first pivot point to facilitate deocclusion and wherein the first fastening strip includes a first guide rail extending in the longitudinal X axis, the slider includes a corresponding guide track slidably engaging said first guide rail.

9. The invention as in claim 8 wherein the first closure portion deflects during deocclusion of said fastening strips.

10. The invention as in claim 8 wherein said first closure portion is a first hook, said third closure portion is a third hook facing toward said first hook, said second closure portion is a second hook, and said fourth closure portion is a fourth hook facing away from said second hook.

11. The invention as in claim 10 wherein said first and third hooks include guide surfaces to guide said first and third hooks with said second and fourth hooks.

12. The invention as in claim 10 wherein said second and fourth hooks include guide surfaces to guide said second and fourth hooks with said first and third hooks.

13. The invention as in claim 8 wherein during deocclusion of the fastening strips, said first closure portion and said second closure portion deflect to deocclude, then said third closure portion and said fourth closure portion shear to deocclude.

14. The closure device of claim 8 wherein the guide rail is disposed between said first web and said third web.

15. A closure device comprising:

first and second interlocking fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, a slider which slidably engages said first and second fastening strips, said slider facilitates the occlusion of said fastening strips when moved towards a first end of said fastening strips and deocclusion of said fastening strips when moved toward a second end of said fastening strips, said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded, the first web deflects during deocclusion of said fastening strips, said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, said third closure portion and said fourth closure portion shear during deocclusion of said fastening strips wherein the separator comprises a front surface, a rear surface, and first and second sidewalls, the first and second sidewalls extending transversely between the front and rear surfaces, the sidewalls engaging the fastening strips during movement towards the second end for deocclusion of the fastening strips, the first and second sidewalls intersecting the front surface at the same angles relative to the Z axis, the first and second sidewalls intersecting the rear surface at different angles relative to the Z axis.

16. The closure device of claim 15 wherein the second sidewall angles continuously outward from the front surface toward the rear surface, the first sidewall includes a rearward portion and a forward portion, the forward portion of the first side wall angling outwardly toward the rearward portion, the rearward portion of the first side wall extending substantially parallel to the X axis.

17. A closure device comprising:

a first fastening strip;

a second fastening strip arranged to be interlocked over a predetermined longitudinal X axis with said first fastening strip, the first and second fastening strips each having upper and lower ends disposed along a vertical Z axis perpendicular to the X axis, said fastening strips having a Y axis perpendicular to the Z and X axes;

a slider slidably engaging said first and second fastening strips, said slider facilitates the occlusion of said fastening strips when moved towards a first end of said fastening strips; and said slider including a housing having a separator for deocclusion of said fastening strips, said separator drives said upper ends of said first and second fastening strips away from each other at different rates in the Y axis when said slider is moved towards a second end of said fastening strips to facilitate deocclusion wherein the separator comprises a front surface, a rear surface, and first and second sidewalls, the first and second sidewalls extending transversely between the front and rear surfaces, the sidewalls engaging the fastening strips during movement towards the second end for deocclusion of the fastening strips, the first and second sidewalls intersecting the front surface at the same angles relative to the Z axis, the first and second sidewalls intersecting the rear surface at different angles relative to the Z axis.

18. The closure device of claim 17 wherein said separator includes forward and rearward portions, the forward portion driving said upper ends of said first and second fastening strips at about the same rate in the Y axis, the rearward portion translating the upper end of the first fastening strip at different rate than the upper end of the second fastening strip in the Y axis.

19. The closure device of claim 18, wherein said rearward portion holds the upper end of the second fastening strip substantially stationary during movement of the slider towards the second end.

20. The closure device of claim 18 wherein the separator translates the upper end of the first fastening strip about twice the distance in the Y axis as the upper end of the second fastening strip.

21. The closure device of claim 17 wherein the angle of the intersection between said first sidewall and the rear surface is about twice the angle of the intersection between said second sidewall and the rear surface.

22. The closure device of claim 21 wherein the second sidewall angles continuously outward from the front surface toward the rear surface, the first sidewall includes a rearward portion and a forward portion, the forward portion of the first side wall angling outwardly toward the rearward portion, the rearward portion of the first side wall extending substantially parallel to the X axis.

23. The closure device of claim 21 wherein said first and second sidewalls are joined by a bottom surface running parallel with said X axis, the first and second sidewalls angling outwardly from the bottom surface towards a top surface.

24. The closure device as in claim 17 wherein the first fastening strip has a pivot point between the upper and lower ends, the separator pivoting the upper and lower ends about the pivot point to facilitate deocclusion.

25. The closure device of claim 18 wherein said slider housing includes a top portion having first and second side portions extending downwardly in the Z axis to straddle the fastening strips, each side portion having a flexible leg extending inwardly in the Y axis, the flexible legs facilitating attachment of the slider to the fastening strips in the Z axis whereby the slider is urged in the vertical Z axis onto the fastening strips with the legs flexing outward and then inward.

26. The closure device of claim 25 wherein each of the first and second fastening strips includes a guide rail slidably engaging the flexible legs to prevent removal of the slider in the Z axis while allowing for movement of the slider in the X axis relative to the fastening strips.

27. A closure device comprising:

a first fastening strip;

a second fastening strip arranged to be interlocked over a predetermined longitudinal X axis with said first fastening strip, the first and second fastening strips each having upper and lower ends disposed along a vertical Z axis perpendicular to the X axis, said fastening strips having a Y axis perpendicular to the Z and X axes;

a slider slidably engaging said first and second fastening strips, said slider facilitates the occlusion of said fastening strips when moved towards a first end of said fastening strips; and said slider including a housing having a separator for deocclusion of said fastening strips, said separator drives said upper ends of said first and second fastening strips away from each other at different rates in the Y axis when said slider is moved towards a second end of said fastening strips to facilitate deocclusion wherein said bottom ends of the first and second fastening strip move towards each other during movement of the slider towards the second end to facilitate deocclusion and wherein the first and second fastening strips have respective pivot points between the upper and lower ends, the separator pivoting the upper and lower ends of each fastening strip about the respective pivot point in opposing directions to facilitate deocclusion and wherein said lower ends include lower interlocking web members and said upper ends include upper interlocking web members, said pivot points disposed between said upper and lower interlocking web members and wherein each of the fastening strips includes a guide rail extending in the longitudinal X axis, the slider includes corresponding guide tracks slidably engaging said guide rails.

28. The closure device of claim 27 wherein said web members include hooks which engage the respective hook.

29. The closure device of claim 27 wherein the guide rails are disposed in the Z axis between said upper and lower interlocking members.

30. The closure device of claim 27 wherein said separator pivots the second fastening strip about 7 degrees and said first fastening strip about 15 degrees.

31. A method of using a closure device comprising:

providing a first fastening strip;

providing a second fastening strip arranged to be interlocked over a predetermined longitudinal X axis with said first fastening strip, the first and second fastening strips each having upper and lower ends disposed along a vertical Z axis perpendicular to the X axis, said fastening strips having a Y axis perpendicular to the Z and X axes;

providing a slider slidably engaging said first and second fastening strips, said slider facilitates the occlusion of said fastening strips when moved towards a first end of said fastening strips, said slider including a housing having a separator for deocclusion of said fastening strips, the first fastening strip has a pivot point between the upper end and the lower end; and moving said slider wherein the separator pivoting the upper end and the lower end about the pivot point to facilitate deocclusion.

32. A method of using a closure device comprising:

providing first and second interlocking fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, providing a slider which slidably engages said-first and second fastening strips, said slider facilitates the occlusion of said fastening strips when moved towards a first end of said fastening strips and deocclusion of said fastening strips when moved toward a second end of said fastening strips, said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded, said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, moving said slider wherein the first web deflects during deocclusion of said fastening strips, said third closure portion and said fourth closure portion shear during deocclusion of said fastening strips.

33. A method of using a closure device comprising:

providing a first fastening strip;

providing a second fastening strip arranged to be interlocked over a predetermined longitudinal X axis with said first fastening strip, the first and second fastening strips each having upper and lower ends disposed along a vertical Z axis perpendicular to the X axis, said fastening strips having a Y axis perpendicular to the Z and X axes;

providing a slider slidably engaging said first and second fastening strips, said slider facilitates the occlusion of said fastening strips when moved towards a first end of said fastening strips, said slider including a housing having a separator for deocclusion of said fastening strips, moving said slider wherein said separator drives said upper ends of said first and second fastening strips away from each other at different rates in the Y axis when said slider is moved towards a second end of said fastening strips to facilitate deocclusion.

* * * * *